US008854263B2

(12) United States Patent
Chiang

(10) Patent No.: US 8,854,263 B2
(45) Date of Patent: Oct. 7, 2014

(54) ANTENNA STRUCTURE AND ELECTRONIC DEVICE HAVING THE SAME

(75) Inventor: Chi-Ming Chiang, Taoyuan County (TW)

(73) Assignee: Auden Techno Corp., Taoyuan County (TW)

( * ) Notice: Subject to any disclaimer, the term of this patent is extended or adjusted under 35 U.S.C. 154(b) by 790 days.

(21) Appl. No.: 13/045,506

(22) Filed: Mar. 10, 2011

(65) Prior Publication Data

US 2012/0229350 A1 Sep. 13, 2012

(51) Int. Cl.

| | |
|---|---|
| ***H01Q 1/38*** | (2006.01) |
| ***H01Q 1/24*** | (2006.01) |
| ***H01Q 5/00*** | (2006.01) |
| ***H01Q 1/22*** | (2006.01) |

(52) U.S. Cl.

CPC ..... *H01Q 5/0055* (2013.01); *H01Q 1/243* (2013.01); *H01Q 1/245* (2013.01); *H01Q 1/2266* (2013.01)

USPC ..... 343/700 MS; 343/702

(58) Field of Classification Search

CPC ..... H01Q 1/243; H01Q 9/42; H01Q 5/0062

See application file for complete search history.

(56) References Cited

U.S. PATENT DOCUMENTS 6,879,293 B2 * 4/2005 Sato ..... 343/702
7,477,199 B2 * 1/2009 Hotta et al. ..... 343/702

* cited by examiner

*Primary Examiner* — Robert Karacsony
(74) *Attorney, Agent, or Firm* — Li & Cai Intellectual Property (USA) Office

(57) ABSTRACT

An antenna structure is disclosed, which includes: a microwave substrate; and a first circuit, a second circuit, and a ground circuit disposed coplanarly on the microwave substrate. The first circuit is an open loop structure with a discontinuous portion having a feed point and a ground point, arranged respectively across the discontinuous portion. The second circuit is connected to a connecting point of the first circuit. The ground circuit is connected to the ground point of the first circuit and the second circuit at the connecting point of the ground circuit. Thus, the antenna structure reduces the SAR. In addition, an electronic device having the same is disclosed.

10 Claims, 8 Drawing Sheets

ANTENNA STRUCTURE AND ELECTRONIC DEVICE HAVING THE SAME

BACKGROUND OF THE INVENTION

1. Field of the Invention

The instant disclosure relates to an antenna structure and electronic device having the same; more particularly, to an antenna structure for wireless communication, in terms of signal receiving and transmission, and electronic device having the same.

2. Description of Related Art

With continuing improvement in wireless technology, personal electronic devices are equipped with antenna structures in a widespread fashion. However, electromagnetic waves off the electronic devices interfere with electromagnets of other surrounding electronic devices. Health-wise, electromagnetic waves are potentially harmful to the brains of the users. Thus, the easing of electromagnetic wave interference and the reduction of specific absorption rate (SAR), defined as the rate at which the energy is absorbed by the human body under the influence of an electromagnetic field, are critical design considerations for antennas.

With continuing research regarding the side effects of electromagnetic radiation about human body, the international standard of SAR for determining health risks due to electromagnetic radiation has become more stringent. Currently, all wireless communication devices sold must be labeled with its SAR value, with the international standard being 2.0 W/kg. In some countries, the SAR limit goes even further, such as 1.6 W/kg. Hence, to gain full acceptance among consumer markets, the design of anti-electromagnetic radiation is a critical ingredient for electronic devices.

SUMMARY OF THE INVENTION

The instant disclosure provides an antenna structure and electronic device having the same, wherein the SAR is reduced.

The disclosed antenna structure comprises: a microwave substrate; a first circuit disposed on the microwave substrate, wherein the first circuit is an open loop structure with a discontinuous portion and has a pair of ends, namely a feed point and a ground point, arranged respectively across the discontinuous portion; a second circuit disposed coplanarly on the microwave substrate at one side of the first circuit, wherein the second circuit is connected to a connecting point of the first circuit; and a ground circuit disposed at another side of the first circuit, wherein the ground circuit is connected to the ground point of the first circuit and the second circuit at the connecting point of the ground circuit.

The instant disclosure also provides an electronic device. The electronic device comprises an upper casing unit, wherein a radio frequency (RF) module and an antenna structure are disposed on the inner surface thereof. The antenna structure comprises: a microwave substrate; a first circuit disposed on the microwave substrate, wherein the first circuit is an open loop structure with a discontinuous portion and has a pair of ends, namely a feed point and a ground point, arranged respectively across the discontinuous portion, and the feed point is connected electrically to the RF module; a second circuit disposed coplanarly on the microwave substrate at one side of the first circuit; a ground circuit disposed at another side of the first circuit, wherein the ground circuit is connected to the ground point of the first circuit and the second circuit at a connecting point of the ground circuit; and a lower casing unit for mating to the upper casing unit, wherein the RF module and the antenna structure are held in between the upper and lower casing unit.

For the above mentioned antenna structure and electronic device having the same, the SAR can be reduced substantially in reaching below 1.6 W/kg. The requirement of antenna efficiency, can be met at the same time.

In order to further the understanding regarding the instant disclosure, the following embodiments are provided along with illustrations to facilitate the disclosure. However, the characteristics of the instant disclosure are by no means restricted thereto.

DETAILED DESCRIPTION OF PREFERRED EMBODIMENTS

Figure 1:
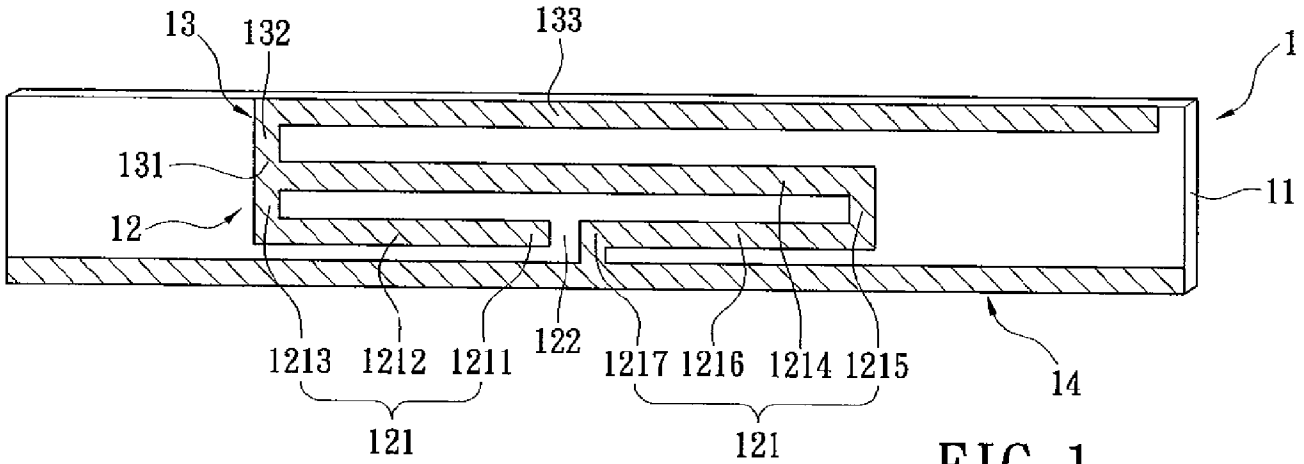
FIG. 1 shows a perspective view for a first embodiment of the instant disclosure.
Figure 2:
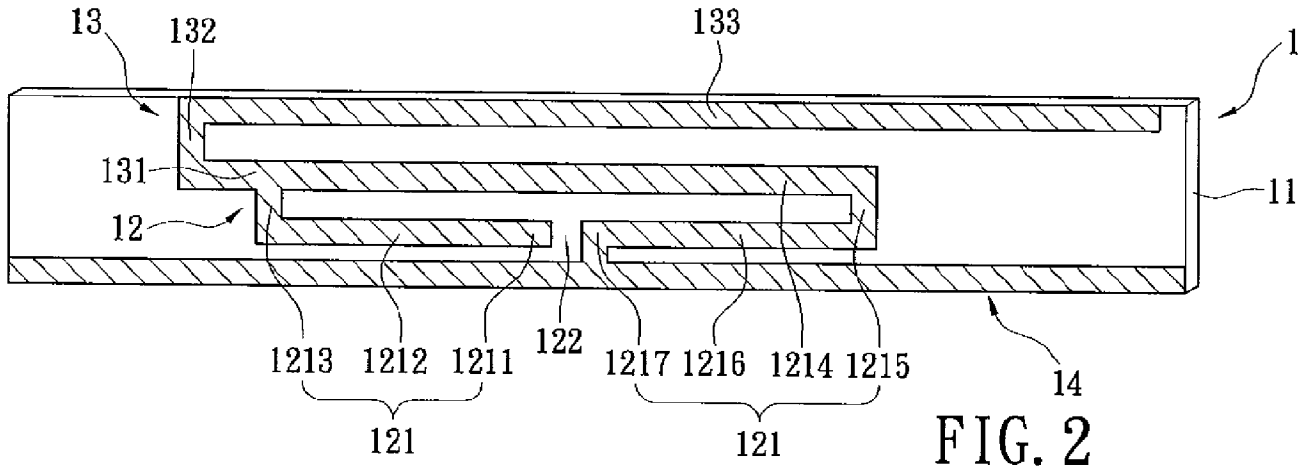
FIG. 2 shows another perspective view for the first embodiment of the instant disclosure.

Please refer to FIGS. 1 to 7, which show a first embodiment of the instant disclosure. As illustrated in FIGS. 1 and 2, an antenna structure 1 comprises a microwave substrate 11, wherein a first circuit 12, a second circuit 13, and a ground circuit 14 are disposed thereon. The microwave substrate 11 has two opposite faces, wherein one of the faces is disposed with the first circuit 12, the second circuit 13, and the ground circuit 14.

The first circuit 12 is an loop structure 121 having a discontinuous portion 122. The first circuit 12 further has a pair of ends, namely a feed point 1211 and a ground point 1217, arranged respectively across the discontinuous portion 122. The ground point 1217 is connected to the ground circuit 14. From the feed point 1211, the first circuit 12 extends toward the ground point 1217 in forming a feed portion 1212, a sub-feed portion 1213, a connecting portion 1214, a sub-ground portion 1215, and a ground portion 1216.

The feed portion 1212, the sub-feed portion 1213, the connection portion 1214, the sub-ground portion 1215, and the ground portion 1216 can be straight. The connecting portion 1214 runs parallel to the feed portion 1212 and the ground portion 1216. The sub-feed portion 1213 runs parallel with the sub-ground portion 1215. Also, the sub-feed portion 1213 is connected perpendicularly to the feed portion 1212 and the connecting portion 1214. The sub-ground portion 1215 is connected perpendicularly to the ground portion 1216 and the connecting portion 1214. With reference to the discontinuous portion 122, the linear alignment between the feed point 1211 and the ground point 1217 is also parallel to the connecting portion 1214.

Furthermore, for the instant embodiment, the feed portion 1212 and the ground portion 1216 can be equal in length, giving the first circuit 12 a symmetrical configuration. The width of the discontinuous portion 122 between the feed point 1211 and the ground point 1217 is shorter than the sub-feed portion 1213. The sub-feed portion 1213 is shorter than the feed portion 1212. However, the above structural relationship is not limited thereto.

The second circuit 13 is connected to a connecting point 131 of the first circuit 12 and disposed on one side thereof. The length from the feed point 1211 to the connecting point 131 of the first circuit 12 is shorter than the length from the ground point 1217 to the connecting point 131. In addition, when the second circuit 13 is connected to the sub-feed portion 1213 at the connecting point 131, the antenna structure 1 has better performance. However, in use, the antenna's circuit arrangement is not limited thereto.

The second circuit 13 extends off the connecting point 131 to form an extension portion 132 and a main portion 133. Structurally, the feed portion 1212, the connecting portion 1214, and the ground portion 1216 of the first circuit 12 are parallel to the main portion 133 of the second circuit 13. The main portion 133 is disposed at one side of the connecting portion 1214, away from the feed portion 1212.

The extension portion 132 can be straight (FIG. 1) or L-shaped (FIG. 2). The main portion 133 is formed by extending perpendicularly from the end of the extension portion 132 at one side of the first circuit 12. The main portion 133 is longer than the connecting portion 1214 of the first circuit 12. However, in use, the circuit arrangement is not limited thereto.

Based on the above, the disclosed antenna structure 1 is arranged such that the resonant mode is approximately at 700~960 MHz and 1700~2200 MHz range. By adjusting the length of various portions for the first circuit 12 and the second circuit 13 or the distance between the first circuit 12 and second circuit 13, the electromagnetic energy between the first circuit 12 and the second circuit 13 can be changed. Thus, the resonant frequency of the antenna structure 1 can be adjusted accordingly. Thereby, the antenna structure 1 can meet the limits of operating bandwidth for various wireless communication services such as WCDMA-FDD (Wideband Code Division Multiple Access-Frequency Division Duplex), GPRS (General Packet Radio Service), and EGPRS (Enhanced General Packet Radio Service).

Please refer to the table below, which shows the technical specifications of the antenna structure 1. As shown in the table, the disclosed antenna structure 1 meets the FCC (Federal Communications commission) SAR criteria of 1.6 W/kg and the antenna efficiency requirement (40%).

| Waveband | Freq. (MHz) | Channel | Antenna Efficiency (%) | SAR (W/kg) |
|---|---|---|---|---|
| WCDMA-FDD B2 | 1852.4 | 9262 | 78.84 | 1.1 |
| WCDMA-FDD B2 | 1880 | 9400 | 79.61 | 1.09 |
| WCDMA-FDD B2 | 1907.6 | 9538 | 80.47 | 1.09 |
| WCDMA-FDD B5 | 826.4 | 4132 | 51.75 | 0.96 |
| WCDMA-FDD B5 | 836.6 | 4183 | 55.75 | 1.01 |
| WCDMA-FDD B5 | 846.6 | 4233 | 58.86 | 1.05 |

Figure 3:
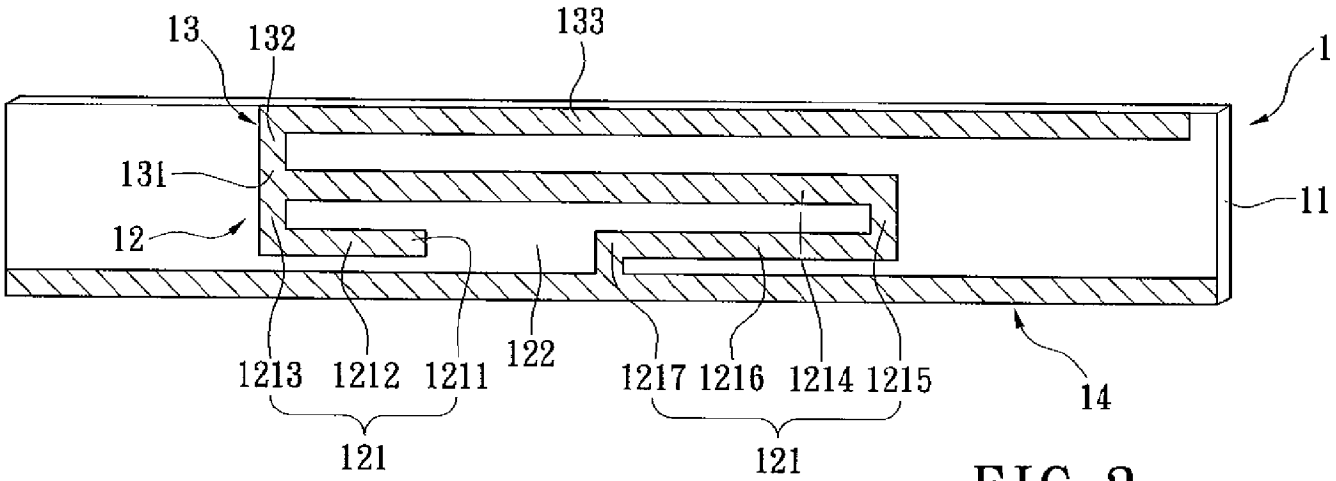
FIG. 3 is a perspective view for the first embodiment of the instant disclosure, showing the feed portion being shorter than the ground portion.
Figure 4:
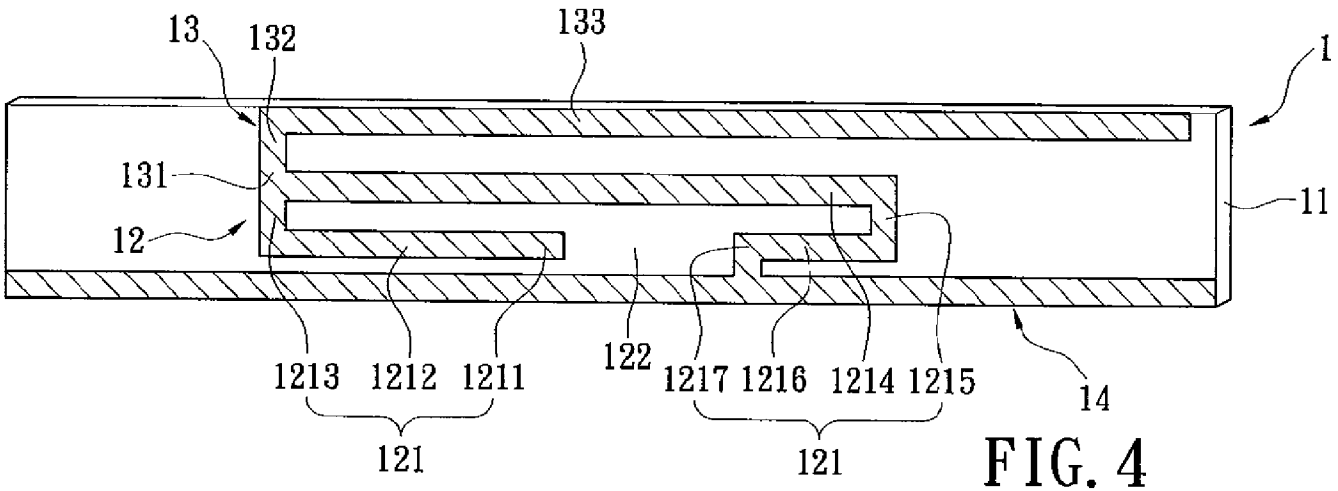
FIG. 4 is a perspective view for the first embodiment of the instant disclosure, showing the feed portion being longer than the ground portion.

In addition, the length comparison between the feed portion 1212 and the ground portion 1216 of the first circuit 12 can be illustrated in FIGS. 3 and 4. Namely, the feed portion 1212 and the ground portion 1216 of the first circuit 12 have different length. In other words, the feed portion 1212 can be shorter than the ground portion 1216 (FIG. 3), or being longer (FIG. 4).

Figure 5:
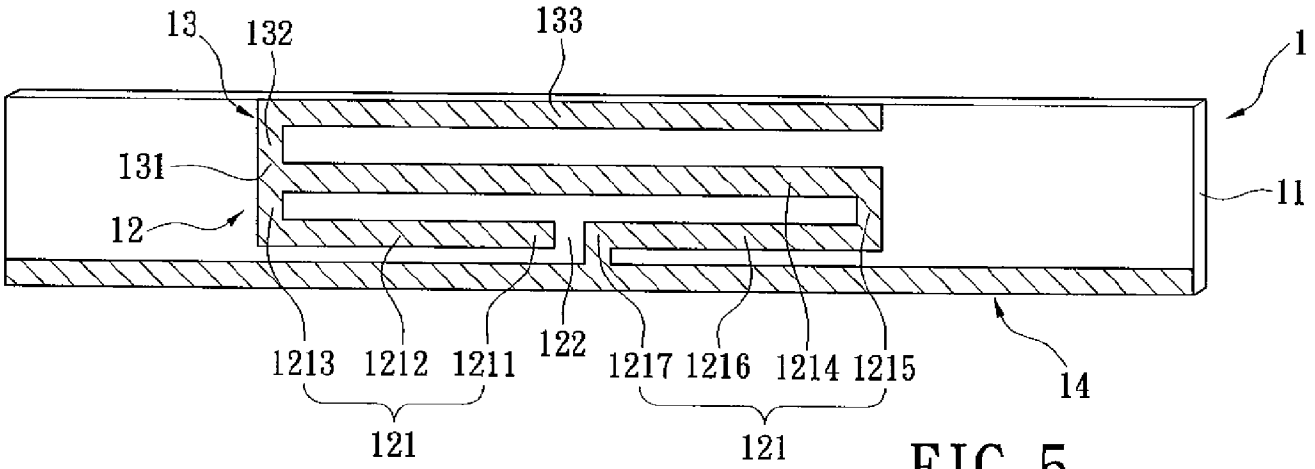
FIG. 5 is a perspective view for the first embodiment of the instant disclosure, showing the main portion and the connecting portion having equal length.
Figure 6:
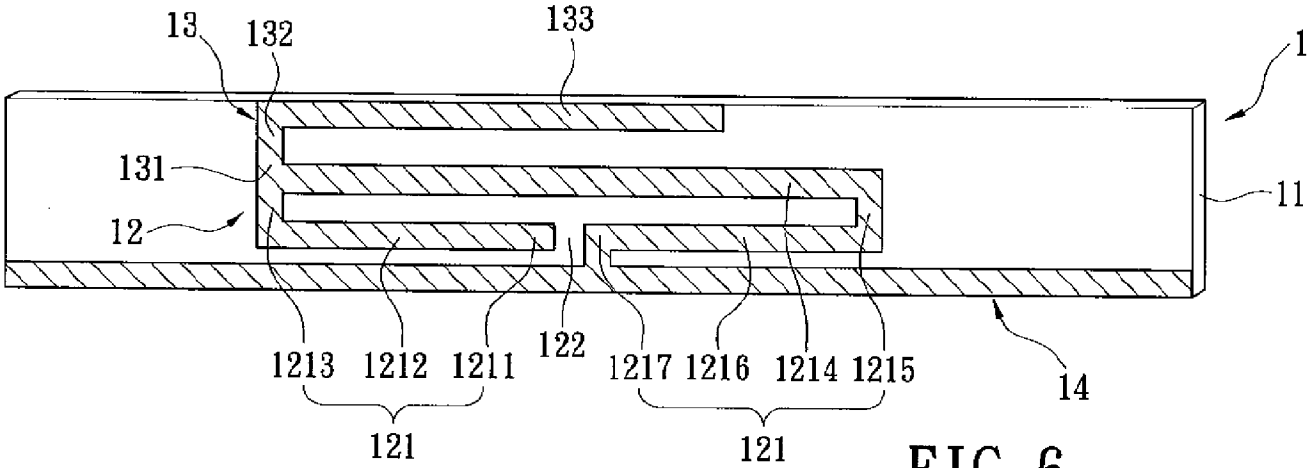
FIG. 6 is a perspective view for the first embodiment of the instant disclosure, showing the main portion being shorter than the connecting portion.

Meanwhile, the length comparison between the connecting portion 1214 of the first circuit 12 and the main portion 133 of the second circuit 13 are shown in FIGS. 5 and 6. Namely, the main portion 133 of the second circuit 13 and the connecting portion 1214 of the first circuit 12 are equal in length (FIG. 5), or the main portion 133 of the second circuit 13 is shorter than the connecting portion 1214 of the first circuit 12 (FIG. 6).

Figure 7:
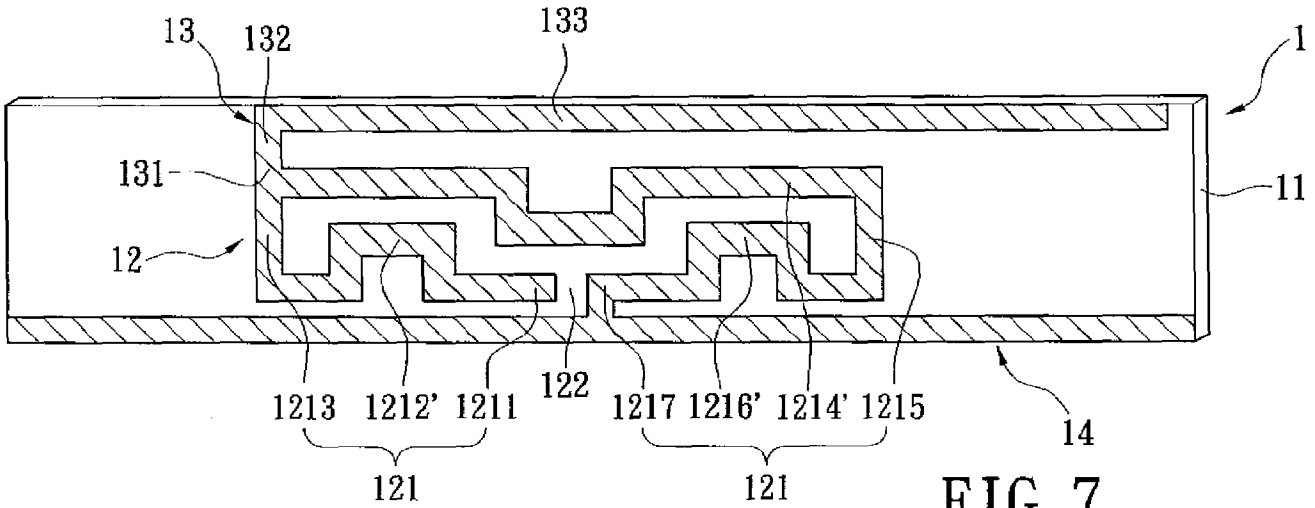
FIG. 7 shows a perspective view for the first embodiment of the instant disclosure having bends.

Furthermore, the first circuit 12 can be configured according to FIG. 7. Namely, bends are added to the feed portion 1212', the connecting portion 1214', and the ground portion 1216' of the first circuit 12. Besides from the feed portion 1212, the connecting portion 1214, and the ground portion 1216, the sub-feed portion 1213 and the sub-ground portion 1215 can have bends as well (not shown).

Figure 8:
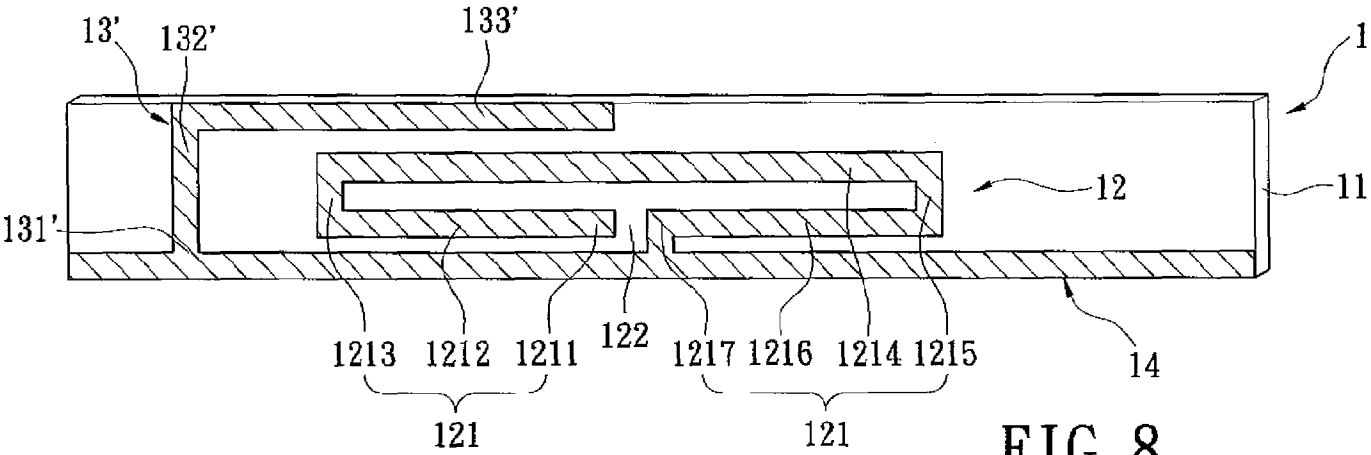
FIG. 8 shows a perspective view for a second embodiment of the instant disclosure.
Figure 9:
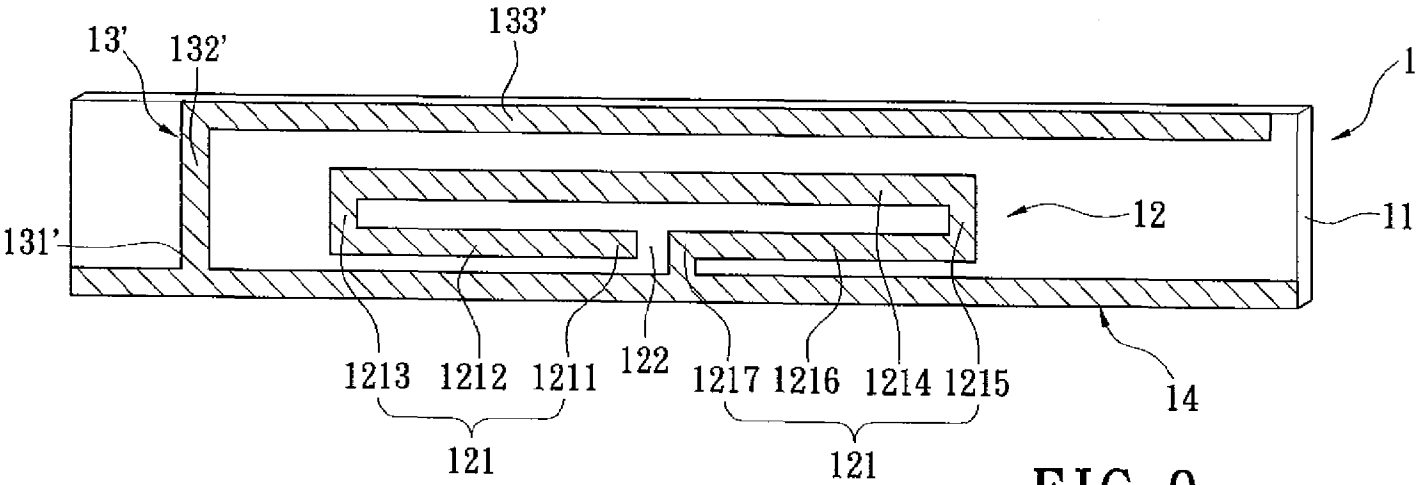
FIG. 9 shows another perspective view for the second embodiment of the instant disclosure.

Please refer to FIGS. 8 and 9, which show a second embodiment for the instant disclosure. The difference between the second and first embodiment is with the second circuit. For the instant embodiment, the second circuit 13' is disposed at one side of the first circuit 12. The second circuit 13' is connected to a connecting point 131' of the ground circuit 14. Distance-wise, the distance between the feed point 1211 of the first circuit 12 to the connecting point 131' of the ground circuit 14 is less than the distance between the ground point 1217 of the first circuit 12 to the connecting point 131' of the ground circuit 14.

The second circuit 13' further extends off the connecting point 131' to form the extension portion 132' and the main portion 133'. The feed portion 1212, the connecting portion 1214, and the ground portion 1216 of the first circuit 12 are parallel to the main portion 133' of the second circuit 13'. The main portion 133' is disposed at one side of the connecting portion 1214, away from the feed portion 1212.

The extension portion 132' can be straight and parallel to the sub-feed portion 1213. The main portion 133' is formed by extending perpendicularly from the end of the extension portion 132' at one side of the first circuit 12. The length of the main portion 133' of the second circuit 13' is dependent of the separation distance between the main portion 133' and the connecting portion 1214 of the first circuit 12. Namely, the shorter the distance between the main portion 133' and the connecting portion 1214, the shorter is the length of the main portion 133' (FIG. 8). Conversely, the longer the distance between the main portion 133' and the connecting portion 1214, the longer is the length of the main portion 133' (FIG. 9).

Please refer to the table below, which shows the technical specifications of the antenna structure 1. As shown in the table, the disclosed antenna structure 1 meets the FCC SAR criteria of 1.6 W/kg and the antenna efficiency requirement.

| Waveband | Freq. (MHz) | Channel | Antenna Efficiency (%) | SAR (W/kg) |
|---|---|---|---|---|
| WCDMA-FDD B2 | 1852.4 | 9262 | 88.65 | 1.21 |
| WCDMA-FDD B2 | 1880 | 9400 | 90.95 | 1.2 |
| WCDMA-FDD B2 | 1907.6 | 9538 | 91.92 | 1.18 |
| WCDMA-FDD B5 | 826.4 | 4132 | 56.84 | 1.39 |
| WCDMA-FDD B5 | 836.6 | 4183 | 60.62 | 1.51 |
| WCDMA-FDD B5 | 846.6 | 4233 | 62.71 | 1.59 |

Figure 10:
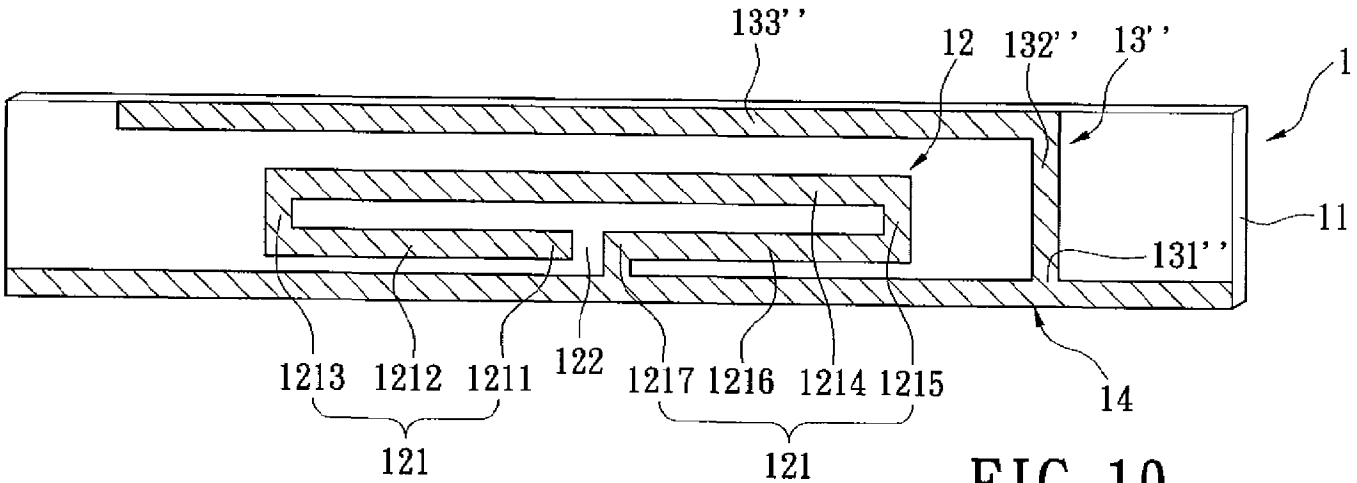
FIG. 10 shows a perspective view for a third embodiment of the instant disclosure.

Please refer to FIG. 10, which shows a third embodiment of the instant disclosure. Likewise, the difference between the third and second embodiment is with the second circuit. For the instant embodiment, the second circuit 13" is formed at one side of the first circuit 12. The second circuit 13" is connected to a connecting point 131" of the ground circuit 14. Distance-wise, the distance between the feed point 1211 of the first circuit 12 to the connecting point 131" of the ground circuit 14 is greater than the distance between the ground point 1217 of the first circuit 12 to the connecting point 131" of the ground circuit 14 (FIG. 10).

Figure 11:
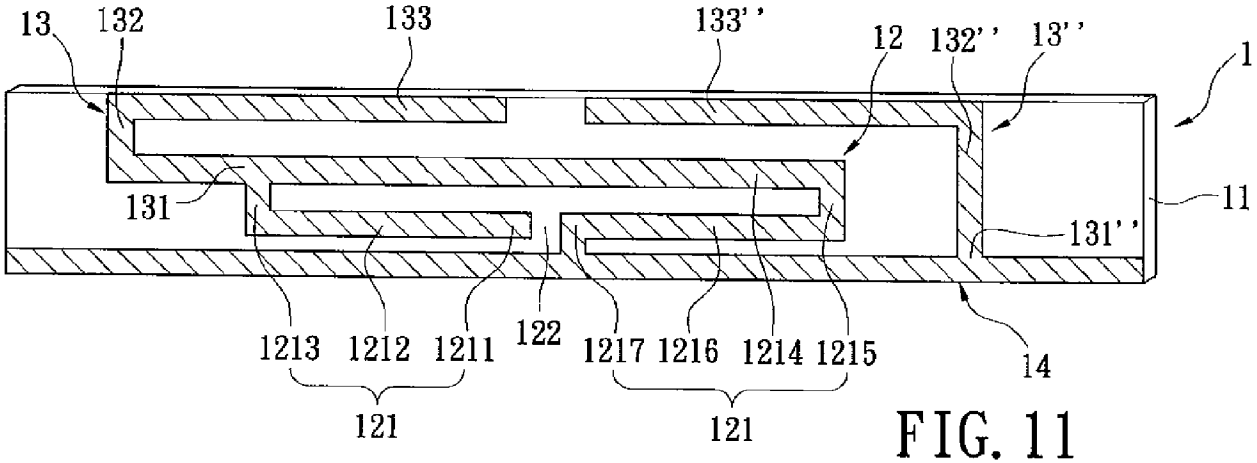
FIG. 11 shows a perspective view for a fourth embodiment of the instant disclosure.
Figure 12:
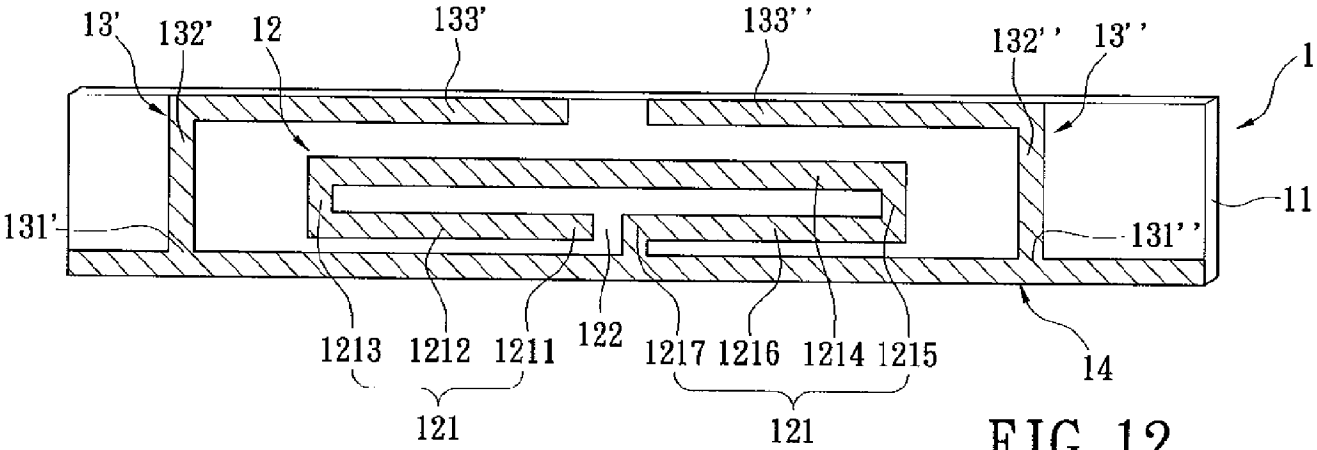
FIG. 12 shows another perspective view for the fourth embodiment of the instant disclosure.

Please refer to FIGS. 11 and 12, which show a fourth embodiment of the instant disclosure. The difference between the fourth and first embodiment is with the second circuit. As shown in FIG. 11, the second circuit 13 of the first embodiment and the second circuit 13" of the third embodiment are disposed coplanarly on the microwave substrate 11.

Alternatively, as shown in FIG. 12, the second circuit 13' of the second embodiment and the second circuit 13" of the third embodiment are disposed coplanarly on the microwave substrate 11.

Figure 13:
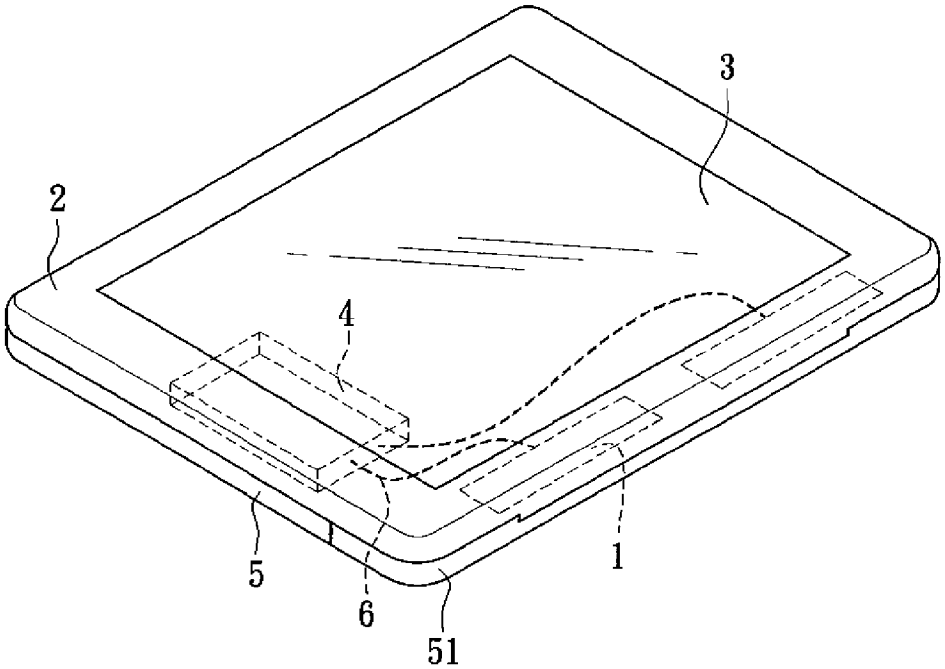
FIG. 13 shows a perspective view for a fifth embodiment of the instant disclosure.
Figure 14:
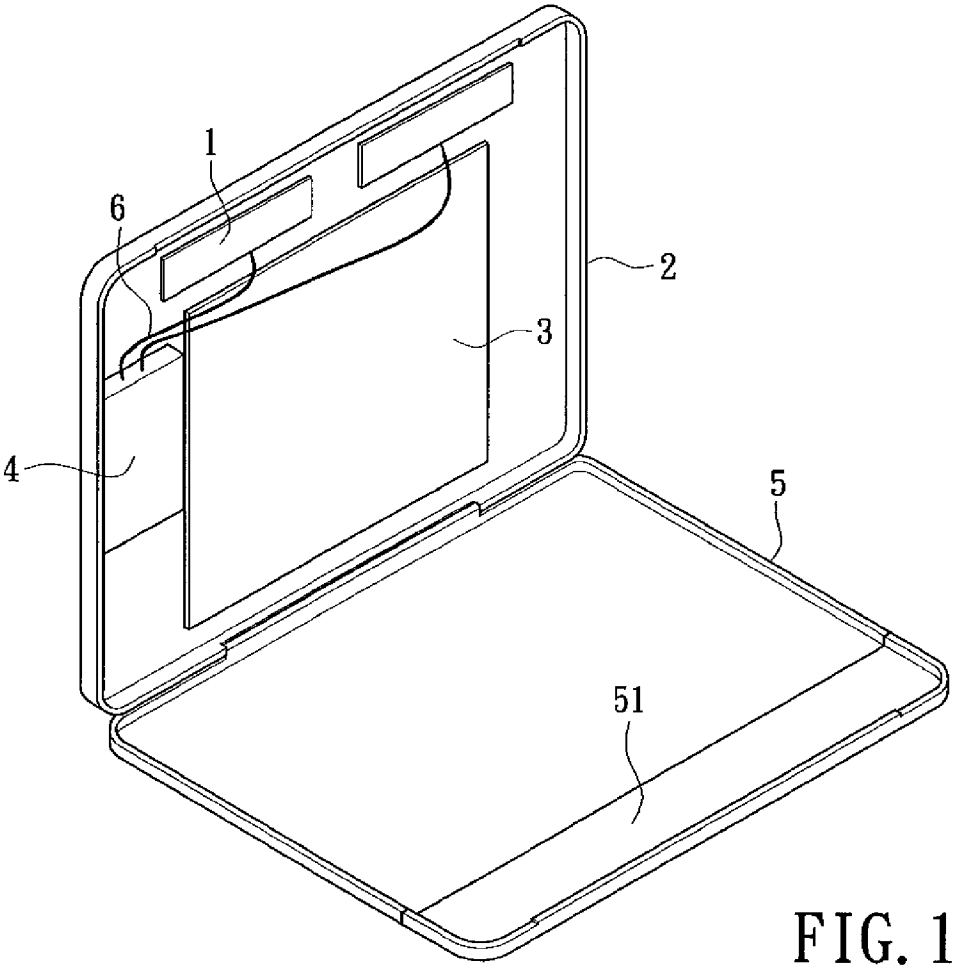
FIG. 14 shows another perspective view for the fifth embodiment of the instant disclosure.

Please refer to FIGS. 13 and 14, which show a fifth embodiment of the instant disclosure. The instant embodiment discloses an electronic device, which comprises an upper casing unit 2 for housing a display 3, a radio frequency (RF) module 4, and an antenna structure 1 on the inner thereof, and a lower casing unit 5 that mates to the upper casing unit 2. The electronic device can be a tablet PC, but is not limited thereto. The encased antenna structure 1 of the instant embodiment is chosen from one of the above-described embodiments.

The display 3 is disposed at the central portion of the inner surface of the upper casing unit 2. The RF module 4 and the antenna structure 1 are disposed beyond the display 3, with the antenna structure 1 being connected to the RF module 4 by a cable 6. The preferred positions of the RF module 4 and the antenna structure 1 are determined arbitrarily. If the RF module 4 is close to the antenna structure 1, a shorter cable 6 can be used. Conversely, if the distance is farther apart, a longer cable 6 is required.

A plastic portion 51 is disposed as part of the outer edge of the lower casing unit 5. To give better signal transmission and receiving performance, the plastic portion 51 is disposed at a corresponding location to the antenna structure 1. Furthermore, the plastic portion 51 and the antenna structure 1 can be disposed at preferred locations. For example, the plastic portion 51 and the antenna structure 1 can be disposed farther away from the user. Thus, when the user is operating the electronic device (e.g. tablet PC), the effect of electromagnetic radiation to the user can be reduced.

According to the above embodiments, the antenna structure and electronic device having the same can reduce the SAR to be under 1.6 W/kg, in addition to meeting the antenna efficiency requirement. Thereby, the instant disclosure meets the performance requirements, while also protecting the user by reducing the effect of electromagnetic radiation.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. An antenna structure, comprising:

a microwave substrate;

a first circuit having a feed point and a ground point disposed on the microwave substrate, the first circuit being an open loop structure having a discontinuous portion on one side thereof, wherein the feed point and the ground point are arranged respectively across the discontinuous portion, the first circuit extends from the feed point toward the ground point to form a feed portion, a sub-feed portion, a connecting portion, a sub-ground portion, and a ground portion, wherein the sub-feed portion is connected perpendicularly to the feed portion and the connecting portion, and wherein the sub-ground portion is connected perpendicularly to the ground portion and the connecting portion;

a ground circuit disposed on the microwave substrate in connection with the ground point of the first circuit and arranged on one side of the first circuit closer to the ground point; and a second circuit disposed on the microwave substrate extendedly connected to a connecting point on the ground circuit and arranged on another side of the first circuit, wherein the second circuit extends from the connecting point to form an extension portion and a main portion formed by extending from the end of the extension portion on one side of the first circuit, wherein the extension portion is straight and parallel to the sub-feed portion, wherein the feed portion, the connecting portion, and the ground portion are parallel to the main portion, and wherein the main portion is disposed at one side away from the feed portion with respect to the connecting portion.

2. The antenna structure of claim 1, wherein the feed portion, the connecting portion, and the ground portion of the first circuit have bends.

3. The antenna structure of claim 1, wherein the distance from the feed point of the first circuit to the connecting point is less than the distance from the ground point of the first circuit to the connecting point.

4. The antenna structure of claim 3, wherein the first circuit is symmetrical, wherein the width across the discontinuous portion between the feed point and the ground point is shorter than the sub-feed portion, and wherein the sub-feed portion is shorter than the feed portion.

5. An electronic device, comprising:

an antenna unit comprising:

a microwave substrate;

a first circuit having a feed point and a ground point disposed on the microwave substrate, the first circuit being an open loop structure having a discontinuous portion on one side thereof, wherein the feed point and the ground point are arranged respectively across the discontinuous portion, the first circuit extends from the feed point toward the ground point to form a feed portion, a sub-feed portion, a connecting portion, a sub-ground portion, and a ground portion, wherein the sub-feed portion is connected perpendicularly to the feed portion and the connecting portion, and wherein the sub-ground portion is connected perpendicularly to the ground portion and the connecting portion;

a ground circuit disposed on the microwave substrate in connection with the ground point of the first circuit and arranged on one side of the first circuit closer to the ground point; and a second circuit disposed on the microwave substrate extendedly connected to a connecting point on the ground circuit and arranged on the another of the first circuit, wherein the second circuit extends from the connecting point to form an extension portion and a main portion formed by extending from the end of the extension portion on one side of the first circuit, wherein the extension portion is straight and parallel to the sub-feed portion, wherein the feed portion, the connecting portion, and the ground portion are parallel to the main portion, and wherein the main portion is disposed at one side away from the feed portion with respect to the connecting portion;

an upper casing unit for housing a radio frequency module and the antenna unit on the inner surface thereof, the radio frequency module being connected electrically to the feed point of the first circuit; and a lower casing unit for matchingly mating with the upper casing unit and forming an enclosure, wherein the radio frequency module and the antenna unit are housed therein.

6. The electronic device of claim 5, wherein the feed portion, the connecting portion, and the ground portion of the first circuit have bends.

7. The electronic device of claim 5, wherein the distance from the feed point of the first circuit to the connecting point is shorter than the distance from the ground point of the first circuit to the connecting point.

8. The electronic device of claim 7, wherein the first circuit is symmetrical, wherein the width across the discontinuous portion between the feed point and the ground point is shorter than the sub-feed portion, and wherein the sub-feed portion is shorter than the feed portion.

9. The electronic device of claim 5, wherein a plastic portion is disposed as part of the outer edge of the lower casing unit, and wherein the antenna structure is disposed with the plastic portion correspondingly, the antenna structure being connected to the radio frequency module by a cable.

10. The electronic device of claim 9, the electronic device being a tablet PC.

* * * * *